US005954238A

United States Patent [19]

Rausch

[11] Patent Number: 5,954,238

[45] **Date of Patent: *Sep. 21, 1999**

[54] KIDNEY-SHAPED BOTTLE AND POUCH

[75] Inventor: Kevin Rausch, Wooster, Ohio

[73] Assignee: Rubbermaid Specialty Products Inc., Wooster, Ohio

[ * ] Notice: This patent is subject to a terminal disclaimer.

[21] Appl. No.: 08/766,286

[22] Filed: Dec. 13, 1996

[51] Int. Cl.[6] ..... A45F 5/00; B65D 23/08

[52] U.S. Cl. ..... 222/158; 62/457.2; 220/903; 222/146.6; 222/175; 222/183; 222/465.1; 224/148.5

[58] Field of Search ..... 222/157–159, 222/183, 175, 465.1, 146.6; 224/148.4, 148.5; 215/379, 380, 382, 383, 396, 398, 394, 365, 11.6, 399; 220/751, 755, 771, 739, 737, 903, 914, 915.1, DIG. 13; 62/457.1–457.4

[56] References Cited

U.S. PATENT DOCUMENTS

| | | | |
|---|---|---|---|
| D. 192,978 | 6/1962 | Garvey | 215/398 X |
| D. 243,637 | 3/1977 | Rabinowitz | D87/1 R |
| D. 304,881 | 12/1989 | Zinbarg et al. | D3/43 |
| D. 330,487 | 10/1992 | Hoelterscheidt | D7/603 |
| D. 347,553 | 6/1994 | Schneider | D7/603 |
| D. 347,971 | 6/1994 | Krugman | D7/607 |
| D. 349,191 | 8/1994 | Mason | D3/289 |
| D. 355,568 | 2/1995 | Paulin et al. | D7/607 |
| D. 385,106 | 10/1997 | Melk | D3/215 |
| 3,830,270 | 8/1974 | Hagert et al. | 224/148.5 X |
| 4,401,245 | 8/1983 | Zills | 220/903 X |
| 4,413,481 | 11/1983 | Thomas | 62/371 |
| 4,653,290 | 3/1987 | Byrne | 62/372 |
| 4,658,975 | 4/1987 | Cone | 222/465.1 X |
| 4,673,117 | 6/1987 | Calton | 224/151 |
| 4,706,856 | 11/1987 | Jacober | 224/151 |
| 4,767,039 | 8/1988 | Jacober | 224/151 |
| 4,871,597 | 10/1989 | Hobson | 220/903 X |
| 4,932,225 | 6/1990 | Bighouse | 62/457.4 |
| 4,941,603 | 7/1990 | Creamer et al. | 224/148 |
| 4,984,662 | 1/1991 | Jacober | 190/107 |
| 5,090,526 | 2/1992 | Jacober | 190/107 |
| 5,188,266 | 2/1993 | Loulias | 224/148.5 X |
| 5,313,807 | 5/1994 | Owen | 62/457.3 |
| 5,394,638 | 3/1995 | Raymond et al. | 43/54 |
| 5,397,039 | 3/1995 | Parcelles | 224/148.5 |
| 5,400,610 | 3/1995 | Macedo | 62/130 |
| 5,680,958 | 10/1997 | Mann et al. | 220/903 X |

OTHER PUBLICATIONS

Rubbermaid Advertisement "Soft–Side Insulated Coolers & Lunch Kit", 1 page, (1994).

*Primary Examiner*—Kevin P. Shaver
*Attorney, Agent, or Firm*—Renner, Kenner, Greive, Bobak, Taylor & Weber

[57] ABSTRACT

A liquid container (10) includes a vessel (12) having a handle (14). The vessel (12) also has a spout (16) having a neck portion (30) extending from the vessel (12) to a ring portion (32). The spout (16) is aligned with the handle (14) and has a centerline (35) that is substantially disposed between two outer planes (37). The outer planes (37) pass through the outer limits of the spout (16) and the outer extremities of the handle (14). The centerline (35) also passes through handle (14) such that when the handle (14) is loosely gripped, the spout (16) is substantially below handle (14). This configuration allows a person to easily pour liquid from the container (10) and predict the direction in which the liquid will leave the spout (16). A pouch (70) is also disclosed for holding the container (10) while allowing the handle (14) of the container (10) to be accessible from the outside of the pouch (70). The pouch (70) also provides an opening (88) for the spout (16) such that liquid may be poured from the container (10) while the container (10) is in the pouch (70).

19 Claims, 4 Drawing Sheets

KIDNEY-SHAPED BOTTLE AND POUCH

TECHNICAL FIELD

This invention relates generally to containers and, in particular, to a kidney-shaped bottle for holding liquid and a pouch for holding the bottles. More specifically, the present invention relates to a kidney-shaped liquid container that has an unique spout position rendering the container easier to pour liquid from.

BACKGROUND ART

Relatively large volumes of liquid are often times difficult for a person to transport because liquid is relatively heavy. There are, however, many situations in which a person may desire to carry a relatively large volume of liquid such as when camping, hiking or picnicking. In these situations, not only must a person carry a relatively heavy volume of liquid, he must also typically carry the liquid over a relatively long distance. Thus, it is desirable to provide a liquid container that holds a relatively large volume of liquid that is comfortable for a person to carry.

One such container is known in the art as a kidney-shaped container. A kidney-shaped container is one having a curved side wall that somewhat conforms to a person's side. These bottles typically have a spout disposed near the top of the container that is aligned with the curve of the container. One problem with the prior art kidney-shaped containers is the difficulties experienced by one who is pouring liquid from the container. Because the overall shape of the container is curved and the spout is aligned with the curve and at one end thereof, the weight of the liquid inside the container creates a torque on the wrist of a person pouring liquid from the container. To counter this torque a person must often use two hands to pour liquid from the container. Another problem with kidney-shaped containers is that the curved side wall displaces the liquid inside of the container in a manner unaccustomed to a typical user. Often, a slight shift in the container results in a large volume of fluid exiting the spout. The curved side walls in combination with the spout location often causes a person to experience difficulty aligning the spout with the receptacle into which the liquid is to be poured resulting in liquid initially missing the receptacle.

Thus, the need exists for a kidney-shaped liquid container having a spout that renders the liquid held in the container easy to pour with a single hand.

DISCLOSURE OF THE INVENTION

It is thus an object of the present invention to provide a kidney-shaped liquid container having a geometry and spout location that renders the container easy to use.

It is another object of the present invention to provide a kidney-shaped liquid container, as above, that has an integrated handle that is aligned with the spout of the container rendering the container easy to use.

It is a further object of the present invention to provide a kidney-shaped liquid container, as above, having graduation marks on the integrated handle such that the volume of liquid in the container may be viewed without opening the container.

It is yet another object of the present invention to provide a kidney-shaped liquid container, as above, with a carrying pouch in which the kidney-shaped liquid container may be carried by means of a shoulder strap, and while the container is in the pouch, liquid may be poured therefrom.

It is still a further object of the present invention to provide a kidney-shaped liquid container and pouch, as above, whereby the pouch allows the handle to be directly grasped while the container is in the pouch.

It is an additional object of the present invention to provide a kidney-shaped liquid container and pouch, as above, wherein the liquid graduation markings on the handle may be viewed when the container is in the pouch.

These and other objects of the present invention, which will become apparent from the description to follow, are accomplished by the improvements hereinafter described and claimed.

In general, a container includes a kidney-shaped vessel with a spout and a handle on the vessel. The spout has a centerline substantially disposed between two outer planes that pass through the outer limits of the spout and the outer extremities of the handle. The container may also be carried by a pouch that allows liquid to be poured from the container when the container is in the pouch.

A preferred exemplary kidney-shaped liquid container and pouch is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
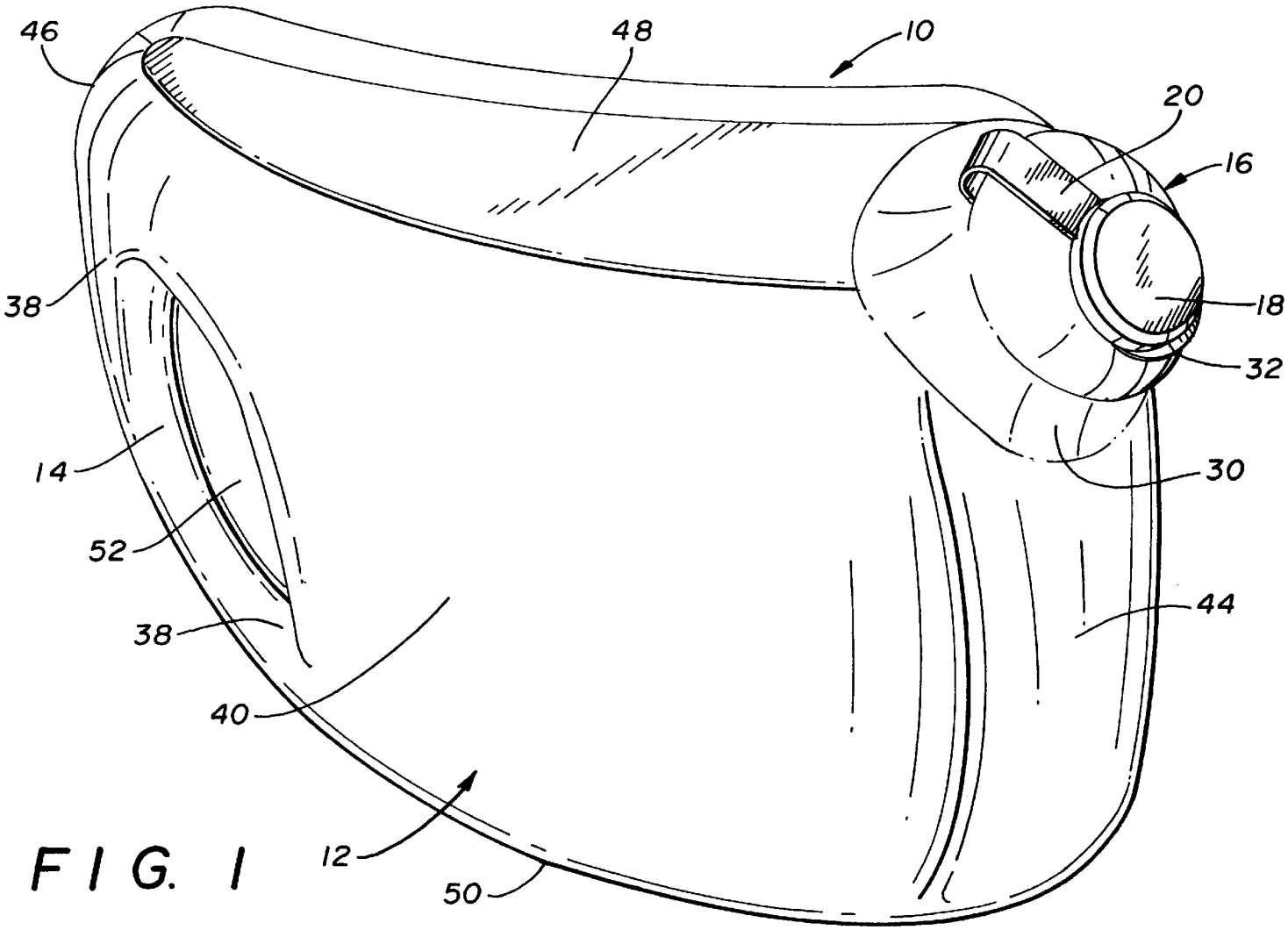
FIG. 1 is a perspective view of a kidney-shaped liquid container made in accordance with the concepts of the present invention.
Figure 2:
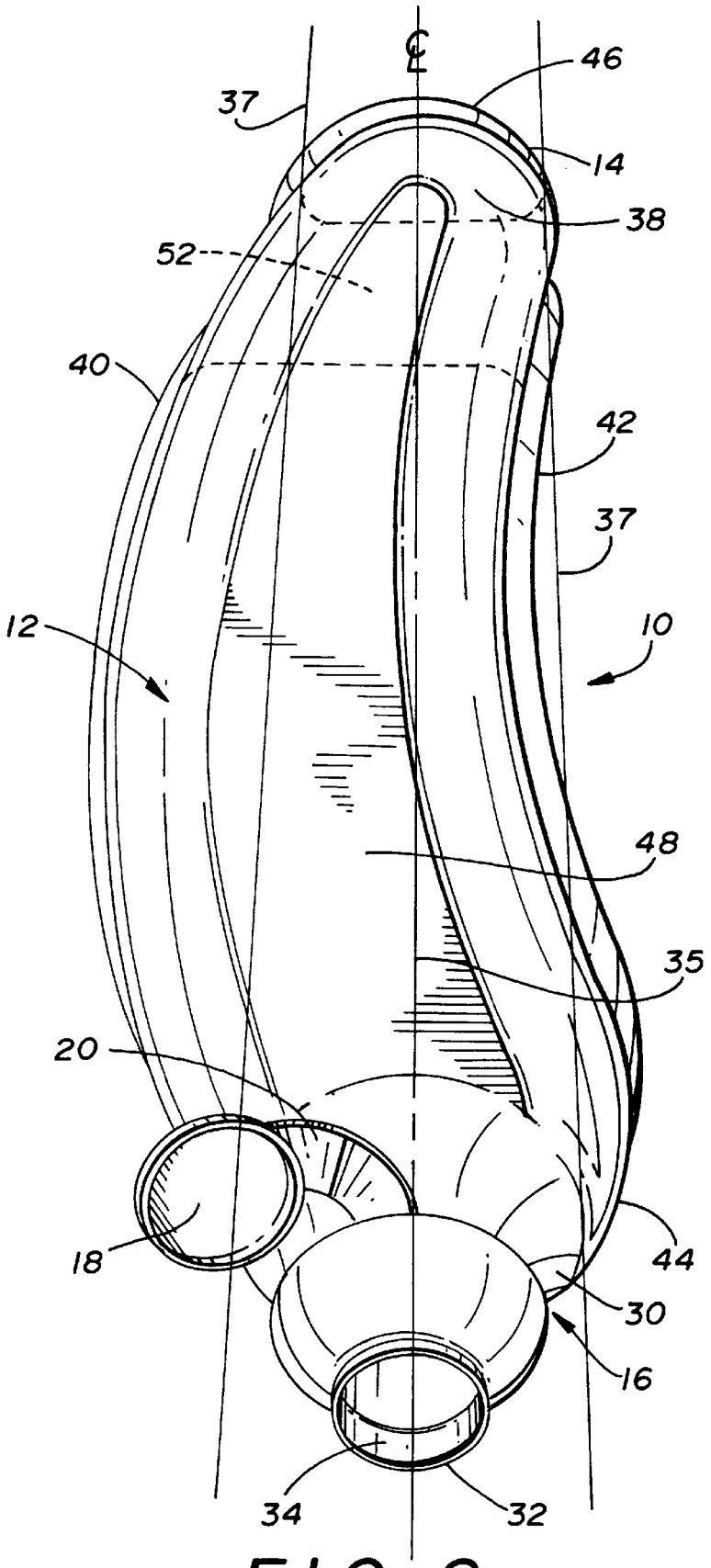
FIG. 2 is a top view of a kidney-shaped liquid container made in accordance with the concepts of the present invention.

A container according to the present invention is indicated generally in the accompanying drawings by the numeral 10. Container 10 may be fabricated from any of a variety of materials, but it has been found that fabricating container 10 from plastic results in a lightweight device that is relatively easy and inexpensive to manufacture.

Container 10 generally includes a kidney-shaped vessel 12 having a handle 14 and a spout 16. As shown in the drawings, handle 14 may be integrally formed in vessel 12. Spout 16 may be selectively closable with a lid 18 that may be attached to container 10 by a tie down strap 20. Lid 18 may also be removably attached to container 10, if desired.

Vessel 12 is filled and emptied through spout 16. As may be seen in FIG. 21, spout 16 includes a neck portion 30 which extends from vessel 12 to a substantially cylindrical pouring ring 32. The side wall 34 of the pouring ring 32 and the geometry of neck portion 30 direct the flow of liquid from vessel 12 when container 10 is in any of many pouring positions.

Spout 16 is positioned on vessel 12 such that liquid may be easily and controllably poured from vessel 12 through spout 16. Spout 16 is positioned such that a compound torsional force is not felt by a person's arm while pouring liquid from container 10. To avoid such undesirable twisting, spout 16 is aligned with handle 14 such that the centerline 35 of spout 16 falls between two outer planes 37. Outer planes 37 are defined by those planes passing through the outer limits of spout 16 and the outer extremities of handle 14. The outer extremities of handle 14 in the embodiment of the invention depicted in the drawings are those two areas 38 where handle 14 connects with vessel 12. As such, the position and location of spout 16 is limited by the location of handle 14.

By positioning spout 16 in the same general reference plane as handle 14, the person's arm is mainly subjected to the weight of container 10 and a simple torsional force. A person is accustomed to compensating for a simple torsion force, and thus the flow of liquid from spout 16 will be predictable to the person pouring liquid from container 10. Thus, a person using container 10 is less likely to initially miss the intended receptacle into which the person is pouring the liquid. Although the person's arm may also experience another torsional force due to the location of the liquid in the container 10, this force will be relatively small and easily compensated for by the person pouring the liquid.

Handle 14 is also positioned such that spout 16 hangs substantially below handle 14 when a person loosely grips handle 14 and allows container 10 to pivot by handle 14. In the embodiment of the invention depicted in the drawings, centerline 35 extends through handle 14. Spout 16 thus hangs directly below handle 14 when handle 14 is loosely gripped and container 10 is permitted to hang freely. Such a situation may not occur when container 10 is at least partially filled with liquid.

Vessel 12 generally includes first and second arcuate side walls 40, 42, respectively. Side walls 40, 42 are joined at one end thereof by a front wall 44. At the other end of side walls 40, 42, a rear wall 46 joins side walls 40, 42. Similarly, a top wall 48 joins the upper portions of side walls 40, 42 and a bottom wall 50 joins the lower portions of side walls 40, 42. The combination of side walls 40, 42, front wall 44, rear wall 46, top wall 48 and bottom wall 50 forms vessel 12. Although in the embodiment of the present invention depicted in the figures spout 16 is disposed at the approximate junction of front wall 44 and top wall 48, other locations for spout 16 are also contemplated by the present invention as long as centerline 35 falls between outer planes 37. Handle 14 is generally located in the lower portion of rear wall 46. Sidewall 42 is generally concave and is intended to be adjacent to a person's body when container 10 is carried. When adjacent one's body, vessel 12 somewhat conforms to the curve of the body rendering container 10 comfortable to carry.

Figure 3:
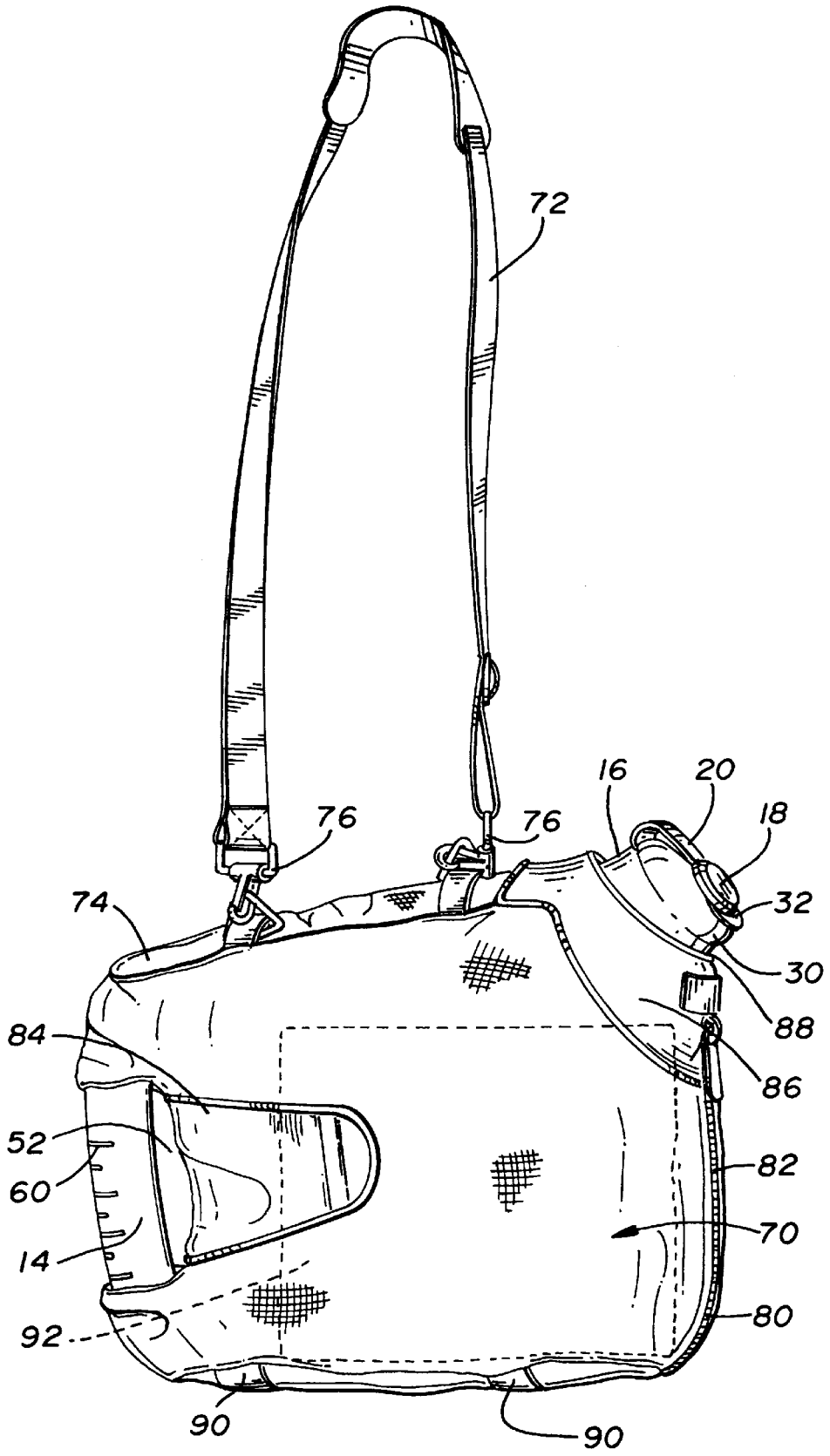
FIG. 3 is a side view of a kidney-shaped liquid container disposed in a pouch made in accordance with the concepts of the present invention.
Figure 4:
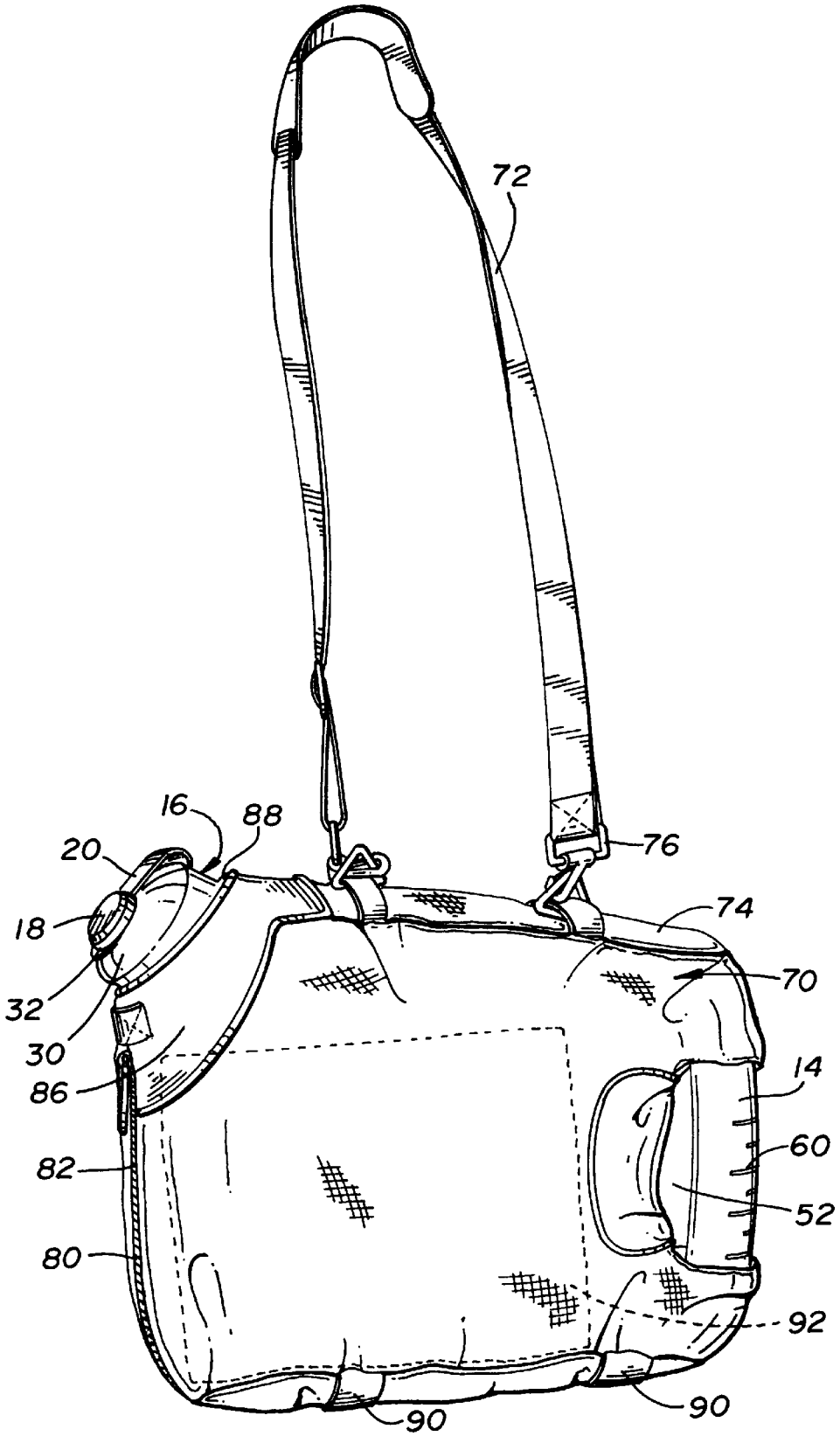
FIG. 4 is a view of the opposite side of a kidney-shaped liquid container disposed in a pouch made in accordance with the concepts of the present invention.

In the embodiment of the present invention depicted in the figures, handle 14 is integrally formed in vessel 12 by providing an opening 52 in vessel 12. Opening 52 is sized to accommodate a person's fingers and thumb when they are wrapped around handle 14. Handle 14 is preferably hollow to thereby define a cavity that is connected to vessel 12 such that liquid in vessel 12 may freely flow into and through handle 14. As may be seen in FIGS. 3 and 4 graduation marks 60 may be disposed on handle 14 such that a person may quickly determine approximately how much liquid is in container 10 without removing lid 18 or feeling the weight of container 10. Graduation marks 60 are disposed to function when container 10 is in an upright position as shown in FIGS. 3 and 4. The material from which at least handle 14 is fabricated must at least be partially transparent to allow graduation marks 60 to properly function.

A pouch for holding container 10 is depicted in FIGS. 3 and 4 and is indicated generally by the numeral 70. Pouch 70 may include a carrying strap 72 that is connected to a top wall 74 of pouch 70 by suitable connectors 76.

Pouch 70 has a selectively closable opening 80 that allows container 10 to be inserted into pouch 70 when opening 80 is open. In the embodiment of the present invention depicted in the figures, opening 80 is selectively closable by a zipper 82 that extends substantially over the entire length of opening 80. In addition to zipper 82, a flap 84 is positionable through opening 52 of vessel 12 and attached back to pouch 70 by a suitable connector (not shown) to tighten pouch 70 around container 10. Flap 84 may be connected back to pouch 70 by any of the known suitable connection devices, such as a hook and loop connector commonly sold under the trademark Velcro®. Flap 84 may also be fabricated from a resilient material such as neoprene such that flap 84 may stretch to tightly fit bottles of slightly differing sizes.

As may also be seen in FIGS. 3 and 4, pouch 70 does not cover handle 14. By not covering handle 14, a person may directly grasp handle 14 and obtain a confident grip on container 10. Graduation marks 60 are also left uncovered.

A neck portion 86 of pouch 70 is fabricated from a resilient material such as neoprene and is configured to snugly engage spout 16. Because neck portion 86 is resilient, it may stretch to accommodate spouts of various sizes. Neck portion 86 has an opening 88 that at least allows ring 32 to protrude from pouch 70 so that liquid may be poured from container 10 while container 10 is in pouch 70. Opening 88 is also configured to allow lid 18 to be attached and removed without interfering with pouch 70.

In general, it is desirable to fabricate pouch 70 from a material, such as nylon or canvas, that is strong enough to support the weight of approximately two gallons of water and is somewhat resistant to liquids that may be spilled thereon. In addition to the strength of the material, a pair of reinforcement straps 90 may be disposed at the bottom of pouch 70. Straps 90 may also be used to attach other articles to pouch 70. It is also desirable to fabricate pouch 70 from a material that insulates container 10. This may be done by fabricating pouch 70 from various layers of material with air pockets therebetween or by providing pockets 92 in which ice packs or other coolants may be added. Such pockets 92 may be disposed on the interior of pouch 70 as depicted in FIGS. 3 and 4.

It should thus be evident that a kidney-shaped liquid container and pouch made in accordance with the present invention provides a container having a spout configuration rendering the container easy to use. The liquid container described herein thus accomplishes the objects of the present invention and otherwise substantially improves the art.

I claim:

1. In combination, a container and a pouch, the container including a kidney-shaped vessel, a spout on said vessel, and a handle on said vessel and being aligned with said spout, said container having graduation marks on said handle, said vessel being received in said pouch.

2. A combination according to claim 1 further comprising at least one reinforcement strap.

3. A container comprising a kidney-shaped vessel, a spout on said vessel, said spout having first and second outer limits, and a handle on said vessel, said handle having first and second outer extremities, said spout having a centerline substantially disposed between a first outer plane and a second outer plane, said first outer plane passing through said first outer limit of said spout and said first outer extremity of said handle, and said second outer plane passing through said second outer limit of said spout and said second outer extremity of said handle.

4. A container according to claim 3 wherein said centerline passes through said handle.

5. A container according to claim 3 wherein said spout includes a substantially cylindrical pouring ring, and a neck portion extending from said vessel to said pouring ring.

6. A container according to claim 3 wherein said handle defines a cavity that is in fluid communication with said vessel.

7. A container according to claim 3 further comprising a lid selectively closing said spout.

8. A container according to claim 3 wherein said vessel includes a pair of arcuate side walls joined by a top wall, a bottom wall, a front wall and a rear wall.

9. A container according to claim 8 wherein said spout is generally disposed at the junction of said front wall and said top wall.

10. A container according to claim 8 wherein said handle is generally located at the lower portion of said rear wall.

11. In combination, a container and a pouch, the container including a kidney-shaped vessel, a spout on said vessel, said spout having first and second outer limits, and a handle on said vessel, said handle having first and second outer extremities, said spout having a centerline substantially disposed between a first outer plane and a second outer plane, said first outer plane passing through said first outer limit of said spout and said first outer extremity of said handle, and said second outer plane passing through said second outer limit of said spout and said second outer extremity of said handle, said vessel being received in said pouch.

12. A combination according to claim 11 wherein said centerline of said spout passes through said handle.

13. A combination according to claim 11 wherein said pouch includes at least one pocket on the interior of said pouch for receiving an ice pack.

14. A combination according to claim 11 wherein said pouch does not cover said handle.

15. A combination according to claim 11 wherein said vessel includes a pair of arcuate side walls joined by a top wall, a bottom wall a front wall, and a rear wall, said spout located at the approximate junction of said front wall and said top wall, and said handle being located in the lower portion of said rear wall.

16. A combination according to claim 11 wherein said pouch includes a selectively closable opening for receiving said vessel, a flap for tightening said pouch on said vessel after said vessel is in said pouch, and a neck portion configured to accept multi-sized spouts.

17. A combination according to claim 16 wherein said neck portion is fabricated from a resilient material.

18. A combination according to claim 16 wherein said flap is fabricated from a resilient material to accept multi-sized vessels.

19. A combination according to claim 16 further comprising a zipper covering substantially said entire opening to selectively open and close said opening.

* * * * *